United States Patent [19]

Gerber

[11] 4,376,677

[45] Mar. 15, 1983

[54] COKE OVEN HEATING WALL

[75] Inventor: Donald J. Gerber, Glenshaw, Pa.

[73] Assignee: Koppers Company, Inc., Pittsburgh, Pa.

[21] Appl. No.: 334,126

[22] Filed: Dec. 24, 1981

[51] Int. Cl.[3] ..... C10B 5/02; C10B 29/02

[52] U.S. Cl. ..... 202/267 A; 202/220

[58] Field of Search ..... 202/220, 267 R, 267 A; 201/18; 266/278, 283

[56] References Cited

U.S. PATENT DOCUMENTS

| | | | |
|---|---|---|---|
| 3,102,846 | 9/1963 | Tucker | 202/220 |
| 4,108,733 | 8/1978 | Gerber | 202/267 A |
| 4,244,786 | 1/1981 | Thubeauville | 202/267 R |

FOREIGN PATENT DOCUMENTS

| | | | |
|---|---|---|---|
| 8774 | 4/1909 | United Kingdom | 202/267 R |

*Primary Examiner*—Bradley Garris

*Attorney, Agent, or Firm*—Daniel J. Long; Herbert J. Zeh, Jr.; Oscar B. Brumback

[57] ABSTRACT

A heating wall on a horizontal coke oven battery. The liner wall section which separates the flues from the oven chambers is characterized by two or more laterally extending rows of vertical ridges. The ridges in adjacent rows are misaligned so as to establish surface turbulence in rising flue gases. As a result of this turbulence and the increased surface area afforded by this configuration, the rate of heat flow through the liner walls is increased so as to increase the rate of carbonization in the oven chambers.

10 Claims, 4 Drawing Figures

COKE OVEN HEATING WALL

BACKGROUND OF THE INVENTION

1. Field of the Invention

The present invention relates to coke ovens and, in particular, to coke oven wall liners.

2. Description of the Prior Art

In most types of horizontal coke oven batteries a heating wall containing vertical combustion flues is interposed between two adjacent coking chambers. It is known that the rate of carbonization in these chambers may be improved by increasing the rate of heat flow through the wall liners between these flues and the oven chambers. One way of increasing the rate of heat flow through these wall liners is, of course, merely to decrease their thicknesses. It is recognized, however, that the extent to which the thicknesses of these wall liners may be reduced is limited by the need to maintain certain levels of structural strength to resist lateral pressures which might be exerted on them by coal charges in the oven chambers and overhead loads imposed by larry cars which traverse the battery top. Accordingly, various designs have been suggested which have, at least in part, the object of increasing the rate of heat flow by increasing the surface area of the wall liner on its surface which is exposed to the heated flue. Such a design is disclosed in U.S. Pat. No. 3,102,846 which proposes that wall liners be constructed so that horizontal layers of brick having a uniform thickness from two and a half to four and a half inches are vertically alternated with horizontal layers of brick having a uniform thickness of from five to eight inches. Although the above mentioned design appears to increase surface area on the flue side of the liner wall so as to increase the rate of heat flow while maintaining a requisite degree of structural strength in the wall liner, it is believed that still better results may be obtained from a design which provides for increased surface area but creates a small amount of surface turbulence in the rising gases in the flue while avoiding more severe turbulence in the central portion of the flue. It is, therefore, the object of the present invention to provide a coke oven wall liner design which allows for adequate structural strength while, at the same time, maximizes the rate of heat flow therethrough and avoids undue turbulence in the flue.

SUMMARY OF THE INVENTION

The present invention is a heating wall which is interposed between two adjacent coking oven chambers in a horizontal coke oven battery. These liner walls are characterized by two arrangements of lateral rows of vertically disposed ridges which depend from the flue side surface of the wall liner. In the first arrangement the ridges are laterally aligned and spaced from one another so that recessed areas are formed between them. Above this row of ridges there is a row of the second type which is also similary laterally aligned and spaced from one another, but they are positioned so that ridges in this row are vertically aligned with recessed spaces in the row below. Above this row of the second type there is positioned a row of the first type so that these rows are alternated through the entire height of the wall liner. The above described ridges preferably are semi-cylindrical in shape and have a radius of about one-half inch and a height of about five inches. This arrangement increases the flue surface area of the wall liner by about fifty percent over that of a flat surface, and it is believed to further increase the rate of heat flow by causing a small amount of surface turbulence in the flue without causing such severe turbulence as might result in the premature combustion of fuel gases in the lower portions of the flue.

BRIEF DESCRIPTION OF THE DRAWINGS

The present invention is further described in the accompanying drawings in which.

DETAILED DESCRIPTION

Figure 1:
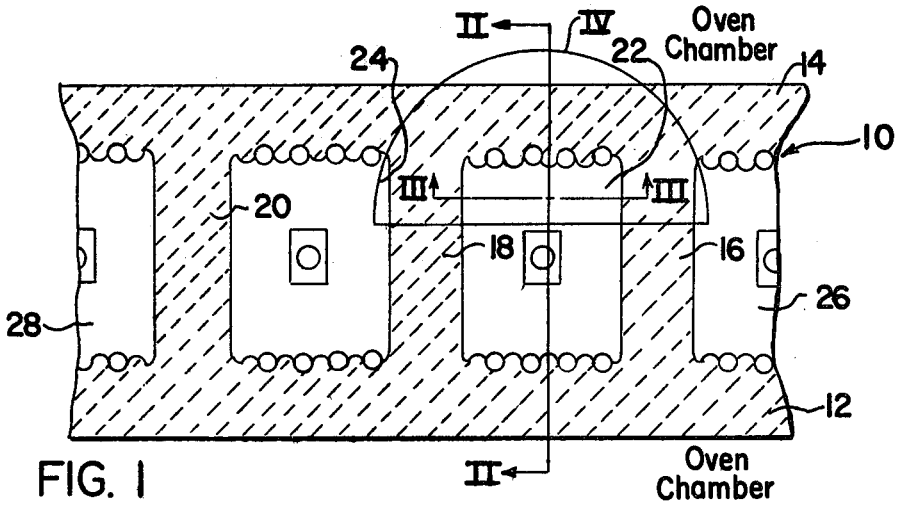
FIG. 1 is a view of a coke oven wall representing one embodiment of the present invention shown in fragment and in horizontal section.

Referring to the drawings, a coke oven intermediate heating wall is shown generally at numeral 10. This wall 10 consists, generally, of a pair of longitudinal liner walls 12 and 14 and a plurality of transverse tying walls as at 16, 18 and 20 which join the liner walls to define a plurality of vertical flues as at 22 and 24. Two other such flues are shown in fragment at numerals 26 and 28. As is known in the art, combustion of fuel gases takes place in these flues to produce heat which flows through the liner walls 12 and 14 to carbonize coal in the adjacent oven chambers.

Figure 2:
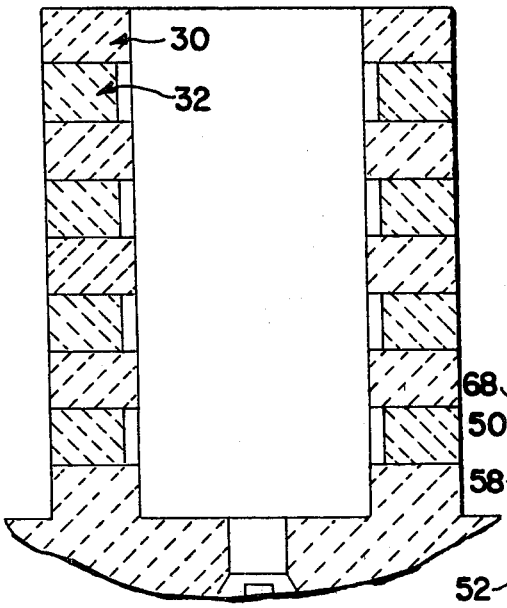
FIG. 2 is a vertical cross sectional view of a coke oven wall of the present invention taken along line II—II of FIG. 1.
Figure 3:
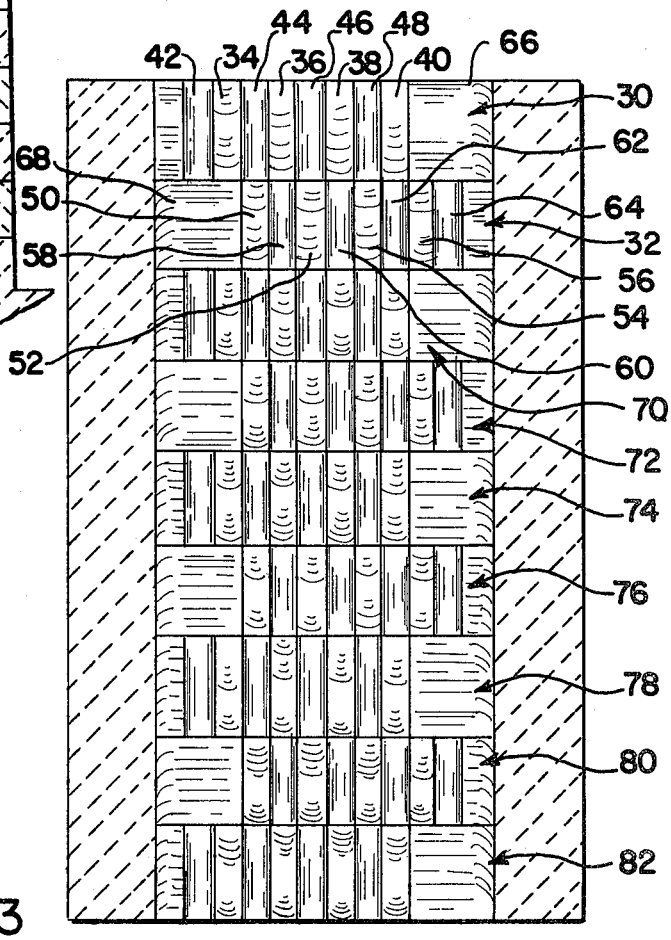
FIG. 3 is a partial vertical enlarged cross sectional view of the coke oven wall of the present invention taken along line III—III of FIG. 1.
Figure 4:
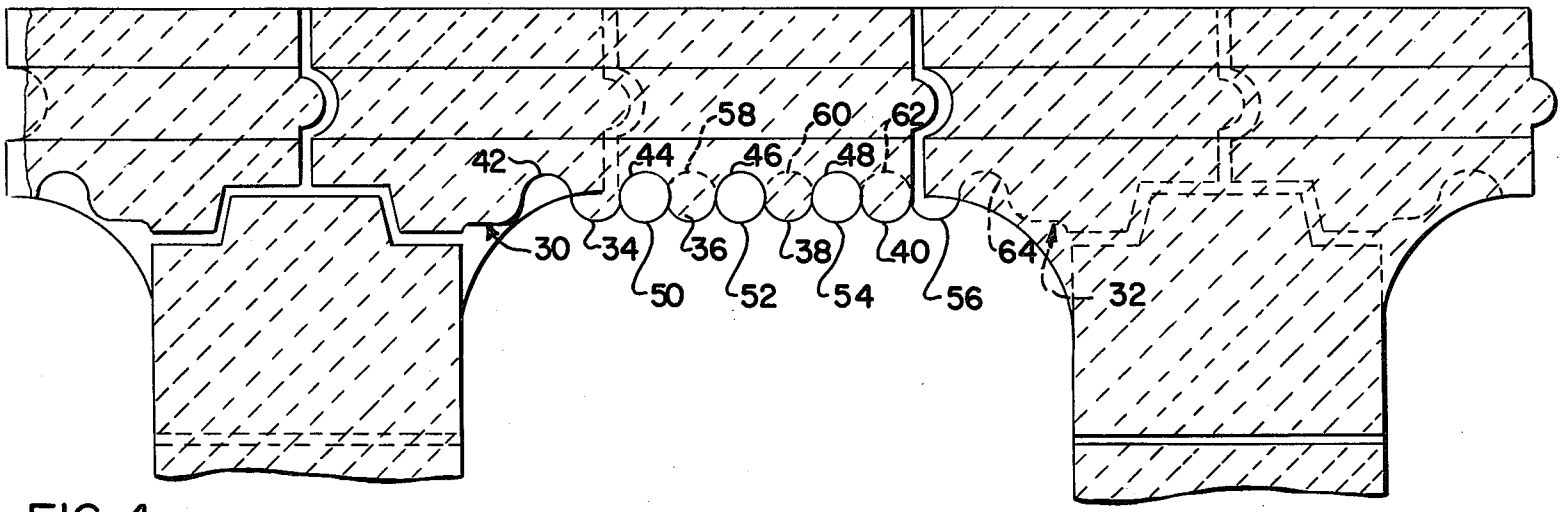
FIG. 4 is a detailed view of the part of the coke oven wall within semi-circle IV on FIG. 1.

Referring particularly to FIG. 2, it will be seen that liner walls are constructed of a plurality of layers of refractory bricks as at 30 and 32. From FIGS. 3 and 4, it will be seen that brick 30 has on its surface adjacent flue 22 a plurality of spaced, longitudinal ridges 34, 36, 38 and 40. The flue surface of brick 30 is also characterized by a plurality of parallel vertical grooves 42, 44, 46 and 48. Brick 32 is included in the layer of bricks below brick 30. This brick is also characterized by a number of vertical ridges 50, 52, 54 and 56 and four vertical grooves 58, 60, 62 and 64. From FIGS. 3 and 4 it will also be seen that to one side of the row of ridges on brick 30 there is formed a planar surface 66 and adjacent the row including brick 32 there is a planar surface 68. For the purposes of this disclosure, such planar surfaces as well as the grooves, since they are all recessed from the ridges, will be collectively referred to as "recessed spaces." It will, therefore, be seen from FIG. 3 that the ridges 34, 36, 38 and 40 on brick 30 are vertically aligned with recessed spaces in the adjacent row of ridges on brick 32. Correspondingly, the ridges 50, 52, 54 and 56 on brick 32 are vertically aligned with recessed spaces on the row of ridges on brick 30. It will also be observed from FIG. 3 that the surface of wall liner 14 adjacent to the flue 22 is also characterized by other laterally aligned rows of vertical ridges shown generally at numerals 70, 72, 74, 76, 78, 80 and 82. Additionally, the ridges in rows 70, 74, 78 and 82 are vertically aligned with recessed spaces in rows 72, 76 and 80. Correspondingly, ridges in rows 72, 76 and 80 are vertically aligned with recessed spaces in rows 70, 74, 78 and 82.

Preferably, the ridges described above are semi-cylindrical and are of about one-half inch in radius and five inches in height. The bricks 30, 32 and other corresponding bricks in the other layers are preferably about three and one-half inches thick from the lower points on their grooves, as at 42 or 58, to their sides adjacent the oven chamber.

The above described liner wall will have about a fifty percent greater surface area on its flue surface than would a corresponding flat surfaced liner wall. Furthermore, it is believed that this arrangement results in the creation of a small amount of surface turbulence in the gases in the vertical flue 22. This surface turbulence would be expected to increase the rate of heat flow through the liner wall, but it would not be expected to be so severe as to cause premature combustion of fuel gases. It will, thus, be appreciated that a coke oven wall liner has been described which allows for a high rate of heat flow, but which also has adequate structural strength to withstand expected stresses.

Although the invention has been described with a certain degree of particularity, it is to be understood that the present disclosure has been made only as an example and that the scope of the invention is defined by what is hereafter claimed.

What is claimed is:

1. In a heating wall interposed between two adjacent coking oven chambers in a horizontal coke oven battery comprising a pair of spaced longitudinal liner walls each of said walls having a flue adjacent surface and an oven adjacent surface and intermediate transverse tie walls tying said liner walls and defining therewith individual vertical combustion flues inside the heating wall, wherein the improvement comprises:

(a) a first row of vertically disposed ridges depending from the flue adjacent surface of at least one liner wall, and being arranged such that said ridges are laterally aligned and spaced from one another to define recessed spaces therebetween; and (b) a second row of vertically disposed ridges depending from said flue adjacent surface of said liner wall and said ridges being laterally aligned above said first row and spaced from one another to define recessed spaces therebetween, and wherein the ridges of said second row are vertically aligned with the recessed spaces of the first row such that surface turbulence is established in rising gases in the flue.

2. The heating wall defined in claim 1 wherein at least a third row of vertically disposed ridges depends from said flue adjacent surface of said liner wall and wherein said ridges are spaced to define recessed spaces and laterally aligned above said second row such that said ridges are vertically aligned with the recessed spaces in said second row of ridges.

3. The heating wall defined in claim 2 wherein at least a fourth row of vertically disposed ridges depends from said flue adjacent surface of said liner wall and wherein said ridges are spaced and laterally aligned above said third row such that said ridges are vertically aligned with the recessed spaces in said third row of ridges.

4. The heating wall defined in claim 3 wherein both flue adjacent surfaces are covered with laterally extending rows of vertically disposed ridges, spaced from one another to define recessed spaces therebetween and wherein ridges in alternating rows are vertically aligned with recessed spaces in an adjacent row.

5. The heating wall defined in claim 4 wherein there are vertically disposed grooves between at least some of said ridges.

6. The heating wall defined in claim 5 wherein said ridges are semi-cylindrical in shape.

7. The heating wall defined in claim 6 wherein said ridges have a radius of about one-half inch.

8. The heating wall of claim 7 wherein said ridges are about five inches in height.

9. The heating wall of claim 8 wherein said grooves have a radial depth of about one-half inch.

10. The heating wall of claim 9 wherein the shortest distance between the flue and oven surfaces of the liner walls is about three and one-half inches.

* * * * *